US005634226A

United States Patent [19]

Oschatz

[11] Patent Number: 5,634,226

[45] Date of Patent: Jun. 3, 1997

[54] APPARATUS AND PROCESS FOR THE CONTINUOUS DYEING OF MESH MATERIAL

[75] Inventor: Christian Oschatz, Schallbach, Germany

[73] Assignee: Sandoz Ltd., Basel, Switzerland

[21] Appl. No.: 534,673

[22] Filed: Sep. 27, 1995

Related U.S. Application Data

[63] Continuation of Ser. No. 223,066, Apr. 1, 1994, abandoned.

[30] Foreign Application Priority Data

Apr. 3, 1993 [DE] Germany ..... 43 10 967.5
Apr. 29, 1993 [DE] Germany ..... 43 14 048.3

[51] Int. Cl.[6] ..... D06B 3/24

[52] U.S. Cl. ..... 8/149.1; 8/149.2; 8/151; 68/5 D; 68/205 R

[58] Field of Search ..... 68/5 D, 205 R; 8/149.1, 149.3, 149.2, 151.1

[56] References Cited

U.S. PATENT DOCUMENTS

| | | | |
|---|---|---|---|
| 2,777,750 | 1/1957 | Sprague et al. | 8/131 |
| 3,085,414 | 4/1963 | Wendler | 68/5 |
| 3,492,838 | 2/1970 | Reiners et al. | 68/5 |
| 3,895,909 | 7/1975 | Greer | 8/176 |
| 3,932,905 | 1/1976 | Houben | 8/149.1 |
| 3,954,404 | 5/1976 | Childers | 8/149.1 |
| 3,986,831 | 10/1976 | von der Eltz et al. | 8/149.1 |
| 4,011,663 | 3/1977 | Moyer | 34/155 |
| 4,182,141 | 1/1980 | Sando et al. | 68/5 |
| 4,404,699 | 9/1983 | Sando et al. | 8/149.1 |
| 4,448,582 | 5/1984 | Johnson | 68/5 D |
| 4,472,950 | 9/1984 | Sando et al. | 68/5 |
| 4,648,250 | 3/1987 | Yabe | 68/5 D |
| 4,843,669 | 7/1989 | Koch et al. | 8/151 |
| 5,010,612 | 4/1991 | Jensen et al. | 8/149.1 |
| 5,265,314 | 11/1993 | Enderlin | 28/278 |
| 5,311,626 | 5/1994 | Strahm | 8/149.1 |
| 5,359,743 | 11/1994 | Von Harten et al. | 8/151 |

FOREIGN PATENT DOCUMENTS

| | | |
|---|---|---|
| 232950 | 4/1964 | Austria . |
| 166316 | 1/1986 | European Pat. Off. . |
| 0249022 | 12/1987 | European Pat. Off. . |
| 2355518 | 5/1975 | Germany . |
| 141690 | 5/1980 | Germany . |
| 3330055 | 2/1985 | Germany . |
| 8805077 | 6/1988 | Germany . |
| 60-30383 | 7/1985 | Japan . |
| 276696 | 10/1951 | Switzerland . |
| 1105062 | 3/1968 | United Kingdom . |
| 1256893 | 12/1971 | United Kingdom . |
| 1456375 | 11/1976 | United Kingdom . |
| 1531034 | 11/1978 | United Kingdom . |
| 2030607 | 4/1980 | United Kingdom . |

*Primary Examiner*—Frankie L. Stinson
*Attorney, Agent, or Firm*—Robert S. Honor; Carl W. Battle; Hesna J. Pfeiffer

[57] ABSTRACT

A modified steamer (D) comprising a heatable conduit (5), through which a substrate (S) can be introduced into the steamer (D) so that the substrate (S) can be preheated directly prior to contact with the steam.

7 Claims, 1 Drawing Sheet

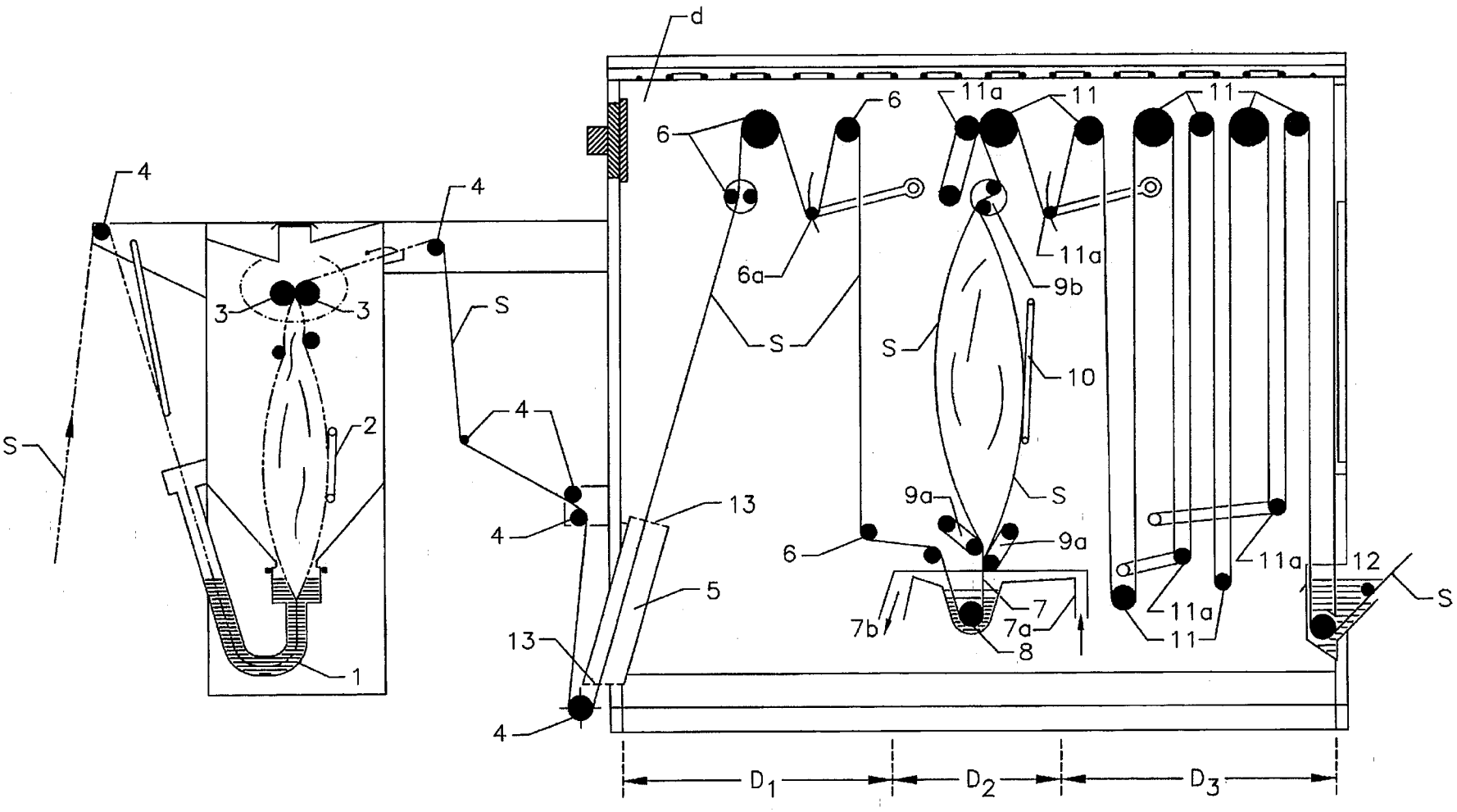
FIGURE

APPARATUS AND PROCESS FOR THE CONTINUOUS DYEING OF MESH MATERIAL

This is a continuation of application Ser. No. 08/223,066, filed Apr. 1, 1994, now abandoned.

The invention relates to an apparatus and a process for the continuous and homogenous dyeing of knitted goods (ie mesh) material especially in tubular form.

All known methods have the disadvantage, so far at least as deep dyeings are concerned, that unlevel dyeings result.

An apparatus and process according to the invention allow deep and level dyeings to be produced.

According to the invention there is provided a steamer, characterisied in that it includes a heatable conduit (5), preferably having heating means directly associated with the conduit (5) through which a substrate can be introduced into the steamer (D).

The function of the conduit (5) in the steamer (D) is that the substrate can be preheated directly prior to contact with the steam and that condensation is avoided on the substrate of the steam.

Preferably the conduit (5) contains one or more heating elements (13) in a heating piece at the circumference of the conduit. Preferably a heating element is located at each rim of the conduit.

While the conduit (5) may be of any suitable geometry, including having circular, rectangular or irregular polygonal crosssection, preferably the conduit is a pipe.

Further according to the invention, there is provided an apparatus for dyeing a tubular substrate comprising means (1) for applying a dyestuff to the substrate (S);

means (4) for introducing the substrate into a steamer (D) comprising a) a heatable conduit (5), through which the substrate (S) can be introduced into the steamer (D) so that the substrate can be preheated directly prior to contact with the steamand to avoid condensation on the substrate of the steam;

b) means (7) for applying a levelling agent and c) means for fixing the dyestuff on the substrate.

Preferably an apparatus according to the invention comprises:

a) a trough or pipe piece (1), into which liquid dyestuff material for dyeing a substrate (S) to be passed through the trough can be introduced, b) means (2) for ballooning the substrate after it passes through the trough (1);

c) means (3) for removing excess liquid dyestuff, located downstream of the trough (1) and means (2);

d) means for introducing the substrate (S) into a conduit (5) of a steamer (D), the conduit (5) being capable of being heated;

e) means for introducing the substrate from the conduit (5) into a trough (7) in the steamer (D), into which trough (7) a levelling agent can be introduced and preferably can be continuously replenished;

f) means (9*a*, 9*b* and 10) within the steamer (D) for ballooning the substrate (S) after it has passed through the trough (7); and g) means (11) within the steamer (D) for fixing the dyestuff on the substrate before the substrate leaves the steamer.

BRIEF DESCRIPTION OF THE DRAWING

The sole FIGURE illustrates a schematic view of a continuous dyeing installation according to the principles of the present invention.

The invention will now be discussed with reference to the FIGURE which shows an embodiment schematically.

The first part of the apparatus comprises a dipping means (1) for dyeing the substrate, a nozzle (2) for introducing compressed air to balloon the substrate, a foulard (3) for removing excess liquid dyestuff and rollers (4) to redirection the substrate. The dipping means (1) can be a dipping trough or pipe piece.

The nozzle (2) is capable of being swivelled so that the degree of ballooning can be optimised.

The roller surfaces of the foulard (3) are made of a soft material having a Shore hardness of 30°–60°.

The second part of the apparatus comprises a steamer (D) according to the invention having a conduit (5) through which the substrate (S) can be introduced (in area $D_1$) into the steamer (D).

A series of movable rollers (6*a* and 11) is provided to enable the substrate (S) to be tensioned properly.

The number of rollers (6, 6*a*, 11 and 11*a*) can be increased or reduced depending on whether the time of dwelling of the substrate in the steamer is increased or reduced.

In steamer D, a trough (7) is provided downstream of rollers (6 and 6*a*) into which the substrate can be introduced in an area $D_2$. Trough (7) is so designed that the substrate (S) can be contacted therein with a levelling liquor (which circulates through trough 7 and is turbulence free) which can be removed from the trough (7) through the overflow (7*b*).

The flow of this liquor is controlled by an apparatus (not shown) that regulates the concentration (or amount) of the levelling assistant in the trough (7), where necessary adjusting, homogenising and pumping it back into the trough (7) through inlet (7*a*).

Downstream of trough (7) are located rollers (9*a* and 9*b*) between which the substrate (S) can be ballooned by means of compressed air nozzle (10). The nozzle (10) is also capable of being swivelled so that the degree of ballooning can be optimised.

Downstream of the ballooning means in area $D_3$, are located rollers (11 and 11*a*) for tensioning the substrate (S) as it dwells in the steam atmosphere for fixation.

Downstream of this tensioning means is located a sluice (12) through which the substrate passes as it leaves the steamer (D).

Still further according to the invention there is provided a process for dyeing and fixing a substrate comprising a) applying a dyestuff in liquid form to a substrate;

b) introducing the dyed substrate to a steamer comprising a heatable conduit, through which the substrate is introduced into the steamer so that the substrate can be preheated directly prior to contact with the steam of the steamer;

c) optionally applying levelling agent in the steamer and d) fixing the dyestuff on the substrate in the steamer.

In a process according to the invention, the substrate in tubular form is impregnated with dyestuff solution in the trough (1). The substrate is then ballooned and passes through foulard (3) via the rollers (4) to a fixing area ($D_1$) of a steamer (D).

The substrate is usually impregnated with about 80–250% (based on the dry weight of substrate) of liquor from the trough (1). In order to produce a good take up (towards 250%) preferably an assistant is added to the dyeing liquor. Preferably such an assistant is a levelling agent for example a copolymer based on acrylamide (for example a material commercially available as Sansapol PB liquid—a trademark of Sandoz Ltd). In this way the mechanical marking due to the foulard (and any unevenness in the substrate through mercerisation) can be compensated for without the need to drain off the liquor. Such an assistant is effective even in small amounts. Preferably such amounts range from 0.05–0.8 g/l more preferably from 0.1 to 0.5 g/l.

The substrate (S) passes into the steamer (D) through a heated conduit (5). The temperature of the Steamer (D) is usually in the range of 98°–102° C. and the atmosphere is saturated with steam. In order to hinder condensation of the steam on the (colder) substrate, the conduit (5) is heated on one or both end rims (13) so that any condensation is almost immediately dried off.

The substrate is kept properly tensioned by series of rollers (6,6*a*).

From these tensioning rollers the substrate is passed through a trough (7) containing a turbulence-free, flowing levelling agent-containing liquor.

The substrate is then ballooned between rollers 9*a* and 9*b* by means of compressed air nozzle 10 and passes into a fixing area D3 over rollers (11 and 11*a*). Fixation is carried out by steam in the steamer (D).

The substrate then passes out of the steamer (D) though sluice (12).

Preferably the material to be treated is a mesh material of a cellulosic material, especially cotton. However the substrate used can also be any other type of tubular mesh material, for example materials of linear aromatic polyester material, cellulose acetate, synthetic polyamide material or polyacrylonitrile fibres, or mixtures of such fibres.

The substrate to be dyed will determine the nature of the dyestuffs to be used.

If cellulosic material, especially cotton, is to be treated then preferably fast dyeing reactive dyestuffs are used, especially fluorotriazinyl group containing dyestuffs or fluorochloropyrimidyl group containing dyestuffs, vinyl sulphone group containing dyestuffs or double anchor reactive dyestuffs.

The temperature of dyeing is usually from 40°–140° C. depending on the dye used.

Dyeing is carried out prior to the first ballooning step from a liquor which in addition to the dyestuff may also contain the standard dyeing assistants. Such assistants may include one or more of the following: oxidation agents, alkali resistant wetting agents, softeners to assist in the easy moving of the substrate in the apparatus of the invention, complexing agents, urea and in particular levelling agents. It is often necessary to have an alkali solution, which is prepared separately from the dyeing solution, containing alkali (sodium carbonate and/or NaOH). This then may be added, typically using a pump, to the dye liquor at a ratio of 1 part alkali solution to 4 parts dye liquor.

The substrate (S) is allowed to dwell in area D1 for a time which depends on the reactivity of the dyestuff used, typically from 3 to 30 seconds.

The temperature of the conduit (5) is usually 85°–120° C., preferably about 110° C.

At this stage, about 70% of the dyestuff is fixed to the substrate.

The substrate (S) passes to trough (7) containing a levelling liquor, which is preferably a concentrated to saturated salt solution of Glauber salt or NaCl optionally also containing sodium carbonate or NaOH. Often in this trough water can be used as the levelling agent.

The liquor of trough (7) is from 70°–95° C.

The dwelling time in the final fixing area $D_3$ is from 50–150 seconds.

The normal actions of rinsing, soaping, rinsing again and drying are carried out conventionally in apparatus not shown in the FIGURE.

The rate of passing the substrate (S) through the dyeing apparatus and steamer is usually 5 to 50 meters per minutes, more preferably 10–25 meters per minute.

For the avoidance of doubt, in this Specification the term "applying a dyestuff" includes "impregnating".

For the avoidance of doubt, steamer includes terms such as steam box or steam chest as is standard in the art.

The invention will now be illustrated by the following Examples in which all parts and percentages are by weight and all temperatures are in °C. unless indicated to the contrary.

EXAMPLE 1

A cotton-jersey substrate in tubular form in a dyeing apparatus as shown in FIG. 1.

The dipping apparatus (1) contains a dyeing liquor containing the following:

- 50 g/l of C.I. Reactive Red 124 (commercially available);
- 0.3 g/l of a commercially available anionic levelling agent (Sansapol PB liquid)
- 10 g/l of a commercially available oxidation agent (Revatol S granulate);
- 6 g/l of an alkali-resistant wetting agent (Sandozin EH, liquid);
- 2 g/l of a softening agent (Imacol JN or Imacol C liquidliquid);
- 2 g/l of a sodium polyacrylate complexing agent (commercially available)
- 150 g/l of urea and
- 2 g/l of NaCl.

This liquor is mixed, using a dispensing pump, with a 20 g/l soda solution in the ratio of 4:1 and the resulting solution is introduced into the trough (1) and is maintained at that same ratio level.

Ballooning occurs using nozzle (2) and excess liquor is removed with foulard (3) to give about 150% uptake (by dry weight of substrate) occur by conventional methods.

With the assistance of a heater in the rim (13) of conduit (5) the lower part of the conduit (5) is heated to about 110° C. It is important that the material does not touch the wall of the conduit (5).

The rate of transportation of the substrate (S) is 10 m per minute and the dwelling time in the fixing area ($D_1$) is 20 seconds.

Substrate S is then introduced into a trough (7) and after leaving this trough is ballooned conventionally by the nozzle (10 between rollers (9*a*) and (9*b*).

After passing the substrate through the final fixing zone ($D_3$), the material is washed with pure water from the sluice (12) and then is conventionally washed hot and cold, soaped, washed again cold and then dried.

The trough (7) is filled with turbulence-free, flowing saturated Glauber salt solution that circulates regularily.

The dwelling time of the substrate (S) in a saturated steam atmosphere of 102° C. is in total 150 seconds.

The resulting dyeing is a perfectly level, deep brilliant red dyeing.

EXAMPLES 2–7

Example 1 can be repeated using, instead of CI Reactive Red 124, the following dyestuffs or dyestuff mixtures.

| Example | | Colour of dyeing |
|---|---|---|
| 2. | 3.2 g/l of C.I. Reactive Yellow 125<br>11.0 g/l of C.I. Reactive Red 147<br>0.2 g/l of C.I Reactive Blue 209 | bright red |
| 3. | 100 g/l of C.I. Reactive Black 5 | black |
| 4. | 0.8 g/l of C.I. Reactive Red 159<br>0.9 g/l of C.I. Reactive Violet 33 | bluish red |
| 5. | 120 g/l of C.I. Reactive Blue 225 | deep blue |
| 6. | 17 g/l of C.I. Reactive Violet 33<br>4 g/l of C.I. Reactive Blue 114 | deep violet |
| 7. | 47 g/l of C.I. Reactive Red 159<br>0.1 g/l of C.I. Reactive Blue 114 | pink |

Level good dyeing result.

EXAMPLE 8

Example 1 is repeated using as the substrate to be dyed a) 170 kg of a cotton-jersey as raw material in tubular form with after bleaching.

b) 50 kg of a pre-bleached cotton jersey in tubular form or c) 50 kg of a modal-viscose substrate with no pretreatment and with a soaping aftertreatment in tubular form in the following dyeing bath:

6 g/l of C. I. Reactive Yellow 125 (commercially available)

78 g/l of C.I. Reactive Red 147 (commercially available)

0.15 g/l of C.I. Reactive Blue 209 (commercially available)

0.3 g/l of a commercially available anionic levelling agent (Sansapol PB liquid)

15 g/l of a commercially available oxidation agent (Revatol S granulate);

6 ml/l of an alkali-resistant wetting agent (Sandozin EH, liquid);

2 ml/l of a lubricant (Imacol C liquid);

2 ml/l of a complexing agent for alkaline earth metal compounds (commercially available as Sandopur RSK liquid)

150 g/l of urea and 2 g/l of NaCl.

This liquor is mixed, using a dispensing pump, with a 20 g/l soda solution in the ratio of 4:1. The rate of goods movement is 12 meters per minute and the steam temperature is 94° C.

Level good dyeings result.

What is claimed is:

1. A process for dyeing and fixing a tubular knitted substrate material comprising the process steps of a) applying a dyestuff in liquid form to said substrate;

b) introducing the dyed substrate to a steamer apparatus (D) having:

walls defining the interior volume of said steamer apparatus (D) suitable for containing saturated or superheated steam;

an inlet in the form of a heatable conduit (5) extending through a first wall of said steamer apparatus (D) and adapted to permit the entry of the dyed substrate for heating directly prior to contact into the steam in the interior volume of said steamer apparatus (D); and an outlet adapted to permit the exit of the dyed and fixed substrate; and c) optionally applying a leveling agent to the substrate in the steamer apparatus.

2. A process according to claim 1 further comprising the process of:

a) applying to said substrate a dyestuff in a liquid form by passing said substrate through a trough containing said dyestuff;

b) ballooning said substrate subsequent to the application of the dyestuff thereupon;

c) introducing said substrate into said steamer apparatus through said heated conduit;

d) transporting said substrate through said steamer apparatus by means of a series of rollers (6 and 6*a*);

e) passing said substrate through a second trough containing a turbulence-free, flowing leveling agent-containing liquor;

f) subsequent to the application of the leveling agent-containing liquor, ballooning said substrate; and g) fixing said dyestuff by contacting said substrate with steam in the steamer apparatus.

3. A process according to claim 1 wherein said substrate is impregnated with 80–250% by weight of the dyestuff in liquid form based on the dry weight of said substrate.

4. A process according to claim 1 wherein the steam-contained in the interior volume of the steamer apparatus is saturated steam at a temperature of 98°–102° C.

5. A process for dyeing and fixing a tubular knitted substrate material comprising the process steps of:

a) applying a dyestuff in liquid form to said substrate;

b) ballooning the dyed substrate thereby produced and thereafter passing it through foulard (3) and the rollers (4) to a fixing area (D1) of a steamer (D) having an inlet in the form of a heatable conduit (5) extending through a first wall of said steamer apparatus (D) and adapted to permit the entry of the dyed substrate for heating directly prior to contact into the interior volume of said steamer (D); and an outlet adapted to permit the exit of the dyed and fixed substrate thereby produced; and c) introducing the substrate into the steamer (D) via said heatable conduit (5);

d) transporting said substrate through said steamer apparatus by means of a series of rollers (6 and 6*a*);

e) passing said substrate through a trough containing a turbulence-free, flowing leveling agent-containing liquor;

f) subsequent to the application of the leveling agent-containing liquor, ballooning said substrate; and g) fixing said dyestuff by contacting said substrate with steam in the steamer apparatus.

6. A process according to claim 5 wherein said substrate is impregnated with 80–250% by weight of the dyestuff in liquid form based on the dry weight of said substrate.

7. A process according to claim 5 wherein the steam-contained in the interior volume of the steamer apparatus is saturated steam at a temperature of 98°–102° C.

* * * * *